US010596050B2

(12) United States Patent
Bellingroth

(10) Patent No.: US 10,596,050 B2
(45) Date of Patent: Mar. 24, 2020

(54) MOTOR-DRIVING MECHANISM AND MOTOR-DRIVEN FURNITURE

(71) Applicants: Jiaxing Sino Hardware Manufacturing Company Limited, Jiaxing, Zhejiang (CN); Sino International Group Limited, Monkok KL (HK)

(72) Inventor: Klaus Bellingroth, Gummersbach (DE)

(73) Assignees: Jiaxing Sino Hardware Manufacturing Company Limited, Jiaxing (CN); Sino International Group Limited, Monkok KL (HK)

( * ) Notice: Subject to any disclaimer, the term of this patent is extended or adjusted under 35 U.S.C. 154(b) by 0 days.

(21) Appl. No.: 16/375,656

(22) Filed: Apr. 4, 2019

(65) Prior Publication Data

US 2019/0231621 A1 Aug. 1, 2019

Related U.S. Application Data

(62) Division of application No. 14/924,404, filed on Oct. 27, 2015, now Pat. No. 10,292,882.

(30) Foreign Application Priority Data

Oct. 29, 2014 (CN) ..... 2014 1 0592006

(51) Int. Cl.
*A61G 7/018* (2006.01)
*A47C 20/04* (2006.01)
*A61G 7/015* (2006.01)

(52) U.S. Cl.
CPC ..... *A61G 7/018* (2013.01); *A47C 20/041* (2013.01); *A61G 7/015* (2013.01)

(58) Field of Classification Search
CPC ..... A47C 20/041; A47C 19/00; A47C 19/12; A47C 20/00; A47C 20/04; A61G 7/018; A61G 7/015
(Continued)

(56) References Cited

U.S. PATENT DOCUMENTS 1,253,625 A 1/1918 Morphis
2,607,929 A 8/1952 Balluff
(Continued)

FOREIGN PATENT DOCUMENTS

CN 202681242 1/2013

OTHER PUBLICATIONS

Glideaway, "Elevation Comfort Base Adjustable Bed," <http://glideaway.com/product/elevation-comfort-base-adjustable-bed/ 81>, web page accessed on Aug. 24, 2016.

*Primary Examiner* — Victor L MacArthur
(74) *Attorney, Agent, or Firm* — Andrew C. Cheng

(57) ABSTRACT

A motor-driving mechanism includes a motor and a lifting lever. The lifting lever is rotatable between a lifted position and a lowered position, and includes first section and a second section. The first section is pivotably connected to the motor. The second section is connected to the first section in such a way that the first section and the second section as a whole are drivable by the motor to rotate in a first direction from the lowered position toward the lifted position, and the first section is drivable by the motor to rotate relative to the second section in a second direction from the lowered position toward a third position while the second section remains at the lowered position, the second direction being opposite to the first direction. A motor-driven bed utilizing the motor-driving mechanism is also disclosed.

16 Claims, 8 Drawing Sheets

(58) Field of Classification Search
USPC ..... 5/13, 20, 35, 36, 42.1–47, 53.2, 57.2, 5/616–617, 634
See application file for complete search history.

(56) References Cited

U.S. PATENT DOCUMENTS

| | | | |
|---|---|---|---|
| 3,138,805 | A | 6/1964 | Piazza |
| 3,281,141 | A | 10/1966 | Smiley et al. |
| 3,754,749 | A | 11/1973 | Lyon et al. |
| 4,057,240 | A | 11/1977 | Damico et al. |
| 4,062,074 | A | 12/1977 | Holland |
| 4,103,170 | A | 7/1978 | Spradlin |
| 4,349,924 | A | 9/1982 | Zur |
| D288,874 | S | 3/1987 | Yosimoto |
| 4,813,088 | A | 3/1989 | DiMatteo et al. |
| 4,987,620 | A | 1/1991 | Sharon |
| 5,095,561 | A | 3/1992 | Green et al. |
| D341,039 | S | 3/1993 | Losagio |
| 5,369,825 | A | 12/1994 | Reesby |
| 5,544,375 | A | 8/1996 | Urness et al. |
| 5,555,582 | A | 9/1996 | Jerideau |
| 5,628,078 | A | 5/1997 | Pennington et al. |
| D384,834 | S | 10/1997 | Midorikawa et al. |
| 6,272,702 | B1 | 8/2001 | Uchida et al. |
| 6,584,629 | B2 | 7/2003 | Tsuji et al. |
| 6,742,206 | B1 | 6/2004 | Han |
| 6,961,971 | B2 | 11/2005 | Schneider et al. |
| 6,986,180 | B1 | 1/2006 | Wilke |
| 7,036,165 | B2 | 5/2006 | Weinman et al. |
| 7,325,265 | B2 | 2/2008 | Hornbach et al. |
| D645,273 | S | 9/2011 | Sakakibara et al. |
| D645,674 | S | 9/2011 | Sakakibara et al. |
| 8,091,165 | B2 | 1/2012 | Mossbeck |
| 8,474,075 | B2 | 7/2013 | Kawakami et al. |
| 8,516,630 | B2 | 8/2013 | Gugliotti et al. |
| 8,677,523 | B2 | 3/2014 | Tsukada et al. |
| 8,683,629 | B2 | 4/2014 | Clenet et al. |
| 8,707,478 | B2 | 4/2014 | Jin |
| 9,049,939 | B2 | 6/2015 | Viberg |
| 9,414,980 | B2 | 8/2016 | Kume |
| 9,414,981 | B2 | 8/2016 | Tsukada et al. |
| 9,462,881 | B2 | 10/2016 | Wang |
| 9,517,172 | B2 | 12/2016 | Kume |
| RE46,367 | E | 4/2017 | Estrada et al. |
| D784,718 | S | 4/2017 | Bellingroth et al. |
| 9,649,234 | B2 | 5/2017 | Kume |
| 9,849,054 | B2 | 12/2017 | Jackson |
| 2002/0144350 | A1 | 10/2002 | Shih |
| 2002/0162410 | A1 | 11/2002 | Zimmerman |
| 2002/0178502 | A1 | 12/2002 | Beasley et al. |
| 2003/0183027 | A1 | 10/2003 | Koch |
| 2004/0129844 | A1 | 7/2004 | Doyle |
| 2004/0187213 | A1 | 9/2004 | Wang |
| 2005/0274303 | A1 | 12/2005 | Kurt et al. |
| 2006/0279143 | A1 | 12/2006 | Platz |
| 2007/0083993 | A1 | 4/2007 | Lindner |
| 2007/0180620 | A1 | 8/2007 | Bellingroth |
| 2008/0289545 | A1 | 11/2008 | Picchio |
| 2010/0325800 | A1 | 12/2010 | Huang |
| 2012/0169093 | A1 | 7/2012 | Kume et al. |
| 2013/0193993 | A1 | 8/2013 | Rawls-Meehan |
| 2014/0053340 | A1 | 2/2014 | Viberg |
| 2014/0082835 | A1 | 3/2014 | Husslage |
| 2014/0191541 | A1 | 7/2014 | Ohta et al. |
| 2014/0319804 | A1 | 10/2014 | Tsukada et al. |
| 2014/0327232 | A1 | 11/2014 | He |
| 2014/0360415 | A1 | 12/2014 | Riis et al. |
| 2015/0082537 | A1 | 3/2015 | Ohta et al. |
| 2015/0297431 | A1 | 10/2015 | Rawls-Meehan |
| 2015/0313369 | A1 | 11/2015 | Tarplee |
| 2015/0320213 | A1 | 11/2015 | Todd |
| 2015/0320627 | A1 | 11/2015 | Tsukada et al. |
| 2016/0120719 | A1 | 5/2016 | Bellingroth |
| 2016/0128885 | A1 | 5/2016 | Latney |
| 2018/0000253 | A1 | 1/2018 | Bellingroth |
| 2018/0008049 | A1 | 1/2018 | Shih |
| 2018/0064259 | A1 | 3/2018 | Shih |
| 2018/0110340 | A1 | 4/2018 | Rawls-Meehan et al. |
| 2018/0140087 | A1 | 5/2018 | Wu |
| 2018/0172062 | A1 | 6/2018 | Hu et al. |

MOTOR-DRIVING MECHANISM AND MOTOR-DRIVEN FURNITURE

CROSS-REFERENCE TO RELATED APPLICATION

This application is a divisional of U.S. patent application Ser. No. 14/924,404, filed Oct. 27, 2015, the contents of each of which is incorporated herein by reference in its entirety.

FIELD

The present invention relates to a driving mechanism and, more particularly, to a motor-driving mechanism and a motor-driven furniture using the motor-driving mechanism.

BACKGROUND

A motor-driven furniture such as a motor-driven bed allows the user to adjust the tilt of the backrest or to elevate the foot rest using a controller to operate the motor to accomplish the desired movement of the bed parts. The motor-driven furniture includes a motor-driving mechanism to lift the backrest or to elevate the foot rest. The motor-driving mechanism usually includes a motor for driving a lifting lever from a lowered position to a lifted position. During transportation, the lifting lever is at the lowered position, with part of the lifting lever protruding out of the bed construction. The height of a carton used for the packaging of the bed is mainly determined by the part of the lifting lever protruding out of the bed construction. This protruding part creates a lot of empty volume in the carton.

SUMMARY

Accordingly, the present invention is directed to a motor-driving mechanism having a reduced packaging thickness.

The present invention is also directed to a motor-driven furniture having a reduced packaging thickness.

A motor-driving mechanism is provided which includes a motor and a lifting lever. The lifting lever is rotatable between a lifted position and a lowered position, and includes first section and a second section. The first section is pivotably connected to the motor. The second section is connected to the first section in such a way that the first section and the second section as a whole are drivable by the motor to rotate in a first direction from the lowered position toward the lifted position, and the first section is drivable by the motor to rotate relative to the second section in a second direction from the lowered position toward a third position while the second section remains at the lowered position, the second direction being opposite to the first direction.

In one embodiment, wherein the motor comprises a linear motor having a motor rod pivotably connected to the first section, and the motor rod is substantially horizontally oriented when the first section is at the third position.

In one embodiment, the motor has a first stop position, a second stop position and a third stop position in between the first and second stop positions. The first stop position and the second stop position define a full stroke of the motor. The first stop position corresponds to the third position of the first section of the lifting lever, the second stop position corresponds to the lifted position of the lifting lever, and the third stop position corresponds to the lowered position of the lifting lever.

In one embodiment, the first section and the second section form a locking mechanism which prevents rotation of the first section in the first direction relative to the second section while permitting rotation of the first section in the second direction relative to the second section.

In one embodiment, the locking mechanism of the first section and the second section comprises a first engaging portion formed on the first section adjacent a joint between the first section and the second section and a second engaging portion formed on the second section adjacent the joint. The first and second engaging portions cooperatively prevent rotation of the first section in the first direction relative to the second section by abutting against each other.

In one embodiment, the first engaging portion comprises a first protrusion, the second engaging portion comprises a second protrusion, and the first protrusion and the second protrusion prevent rotation of the first section in the first direction relative to the second section by abutting against each other.

In one embodiment, the first engaging portion comprises a protrusion, the second engaging portion comprises a recess, and the protrusion is engaged in the recess to prevent rotation of the first section in the first direction relative to the second section.

In one embodiment, the second section comprises a rotating axle, one or more lifting arms and a connecting lever are fixedly attached to the rotating axle. The first section is pivotably connected to the connecting lever. The first section and the connecting lever form a locking mechanism which prevents rotation of the first section in the first direction relative to the connecting lever while permitting rotation of the first section in the second direction relative to the connecting lever.

In one embodiment, the second section comprises a rotating axle having a plurality of separate rotating axle sections each fixedly attached with one or more lifting arms. A plurality of connecting levers is fixedly attached to the rotating axle sections, respectively, and the first section is pivotably connected to the plurality of connecting levers. The first section and the plurality of connecting levers form a locking mechanism which prevents rotation of the first section in the first direction relative to the plurality of connecting levers while permitting rotation of the first section in the second direction relative to the plurality of connecting levers.

In one embodiment, the first section comprises a shaft and a plurality of connecting levers fixedly attached to the shaft. Each of the plurality of connecting levers of the first section is pivotably connected to a corresponding one of the plurality of connecting levers of the second section. The locking mechanism is formed between each of the plurality of connecting levers of the first section and each of the plurality of connecting levers of the second section.

In one embodiment, a motor connecting lever is fixedly attached to the shaft of the first section, and the motor comprises a linear motor having a motor rod pivotably connected to the motor connecting lever.

A motor-driven furniture is provided which includes a frame, a lifting lever mounted to the frame, and a motor. The lifting lever is mounted to the frame for rotation between a lifted position in which a liftable part of the furniture is lifted and a lowered position in which the liftable part of the furniture is lowered. The lifting lever includes a first section and a second section pivotably connected to the first section. The first section and the second section form a locking mechanism which prevents rotation of the first section relative to the second section in a first direction from the lowered position toward the lifted position while permitting rotation of the first section relative to the second section in a second direction from the lowered position toward a third position, the second direction being opposite to the first direction. The motor is connected to the first section for rotating the first section.

In one embodiment, the furniture is a motor-driven bed, and the liftable part of the furniture is one of a backrest and a footrest of the motor-driven bed.

In one embodiment, the furniture is a motor-driven bed, and the motor is connected to the bed by a connecting lever having first and second connecting pieces. The first connecting piece is fixedly attached to the bed. The second connecting piece is rotatably connected to the first connecting piece for rotation between an upper position and a lower position. The connecting lever includes another locking mechanism configured to prevent rotation of the second connecting piece in a direction away from the upper position while permitting rotation of the second connecting piece toward the upper position when the second connecting piece is at the lower position. During the course of the lifting lever rotating from the lowered position toward the lifted position, the second connecting piece is at the lower position.

In one embodiment, the locking mechanism comprises a first protrusion formed on one of the first section and the second section, and a second protrusion formed on the other of the first section and the second section. The first protrusion and the second protrusion prevent rotation of the first section in the first direction relative to the second section by abutting against each other.

In one embodiment, the locking mechanism comprises a protrusion formed on one of the first section and the second section, and a recess formed on the other of the first section and the second section. The protrusion is engaged in the recess to prevent rotation of the first section in the first direction relative to the second section.

In one embodiment, the second section comprises a rotating axle, one or more lifting arms fixedly attached to the rotating axle for lifting the liftable part of the furniture, and a connecting lever fixedly attached to the rotating axle. The first section is pivotably connected to the connecting lever. The locking mechanism is formed between the first section and the connecting lever.

In one embodiment, the second section comprises a rotating axle having a plurality of separate rotating axle sections. Each of the rotating axle sections is fixedly attached with one or more lifting arms. A plurality of connecting levers is fixedly attached to the rotating axle sections, respectively. The first section comprises a shaft and a plurality of connecting levers fixedly attached to the shaft. Each of the plurality of connecting levers of the first section is pivotably connected to a corresponding one of the plurality of connecting levers of the second section. The locking mechanism is formed between the plurality of connecting levers of the first section and the plurality of connecting levers of the second section.

A motor-driven furniture additionally provided which includes a frame, a lifting lever and a motor. The lifting lever is mounted to the frame for rotation between a lifted position in which a liftable part of the furniture is lifted and a lowered position in which the liftable part of the furniture is lowered. The lifting lever includes a first section and a second section connected to the first section. The second section configured to support the liftable part of the furniture. The motor is connected to the first section. The motor is configured to drive the first section and the second section as a whole to rotate in a first direction from the lowered position toward the lifted position. The motor is further configured to drive the first section to rotate relative to the second section in a second direction from the lowered position toward a third position, the second direction being opposite to the first direction.

In one embodiment, the motor-driven furniture is a motor-driven bed having a platform supported on the frame. The motor is connected to one of the frame and the platform by a connecting lever having first and second connecting pieces. The first connecting piece is fixedly attached to the one of the frame and the platform, and the second connecting piece is rotatably connected to the first connecting piece for rotation between an upper position and a lower position. The connecting lever includes another locking mechanism configured to prevent rotation of the second connecting piece in a direction away from the upper position while permitting rotation of the second connecting piece toward the upper position when the second connecting piece is at the lower position. When the first connecting piece is at the upper position and the first section of the lifting lever is at the third position, the combination of the connecting lever, the motor and the lifting lever has a smallest size protruding beyond the frame in a direction perpendicular to the frame.

In view of the foregoing, the lifting lever includes a first section and a second section. The first section is rotatable from the lowered position to the third position, thus reducing the thickness of the motor-driving mechanism and the motor-driven furniture utilizing the motor-driving mechanism. In some embodiments, the motor is connected to the furniture by a connecting lever having a first connecting piece and a second connecting piece. The second connecting piece is rotatable from the lower position to the upper position, which further reduces the thickness of the motor-driving mechanism and the motor-driven furniture utilizing the motor-driving mechanism. The reduced thickness can result in more beds to be loaded into one container during transportation and as a result, the shipping cost per unit is reduced.

Other independent aspects of the invention will become apparent by consideration of the detailed description, claims and accompanying drawings.

DESCRIPTION OF THE EMBODIMENTS

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

FIGS. 1 to 8 illustrate a motor-driven furniture according to one embodiment. In this embodiment, the motor-driven furniture is illustrated as a motor-driven bed which has a liftable part drivable by a motor-driving mechanism. Those skilled in the art will appreciate that the present invention can be equally applied to another type of furniture with liftable part, such as, power chairs, upon reading the teachings of this disclosure.

Figure 1:
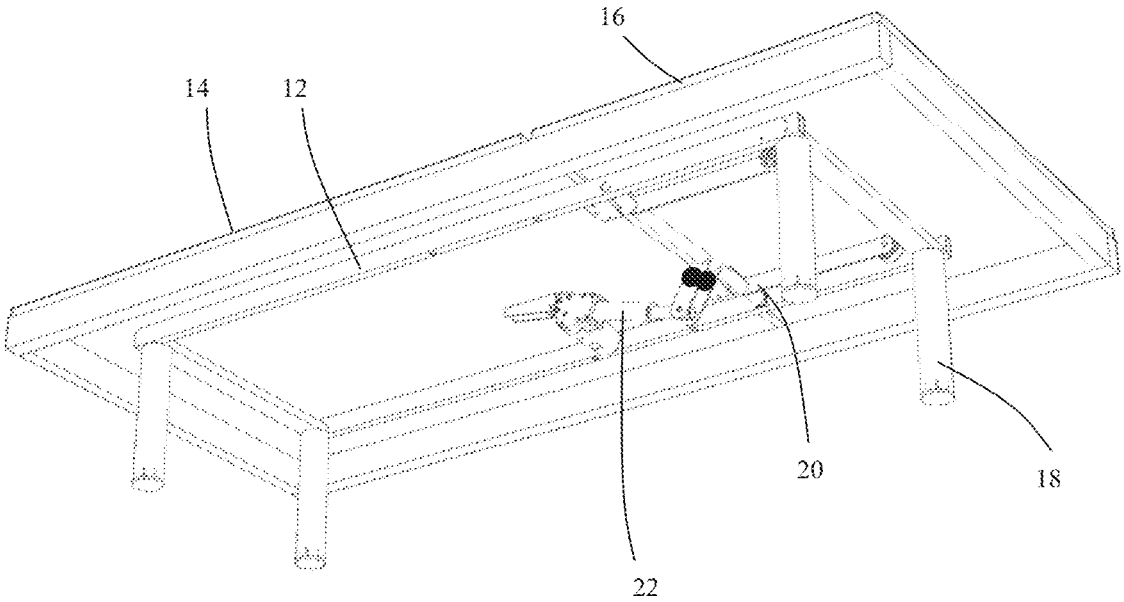
FIG. 1 is a perspective view of a motor-driven furniture according to one embodiment.
Figure 2:
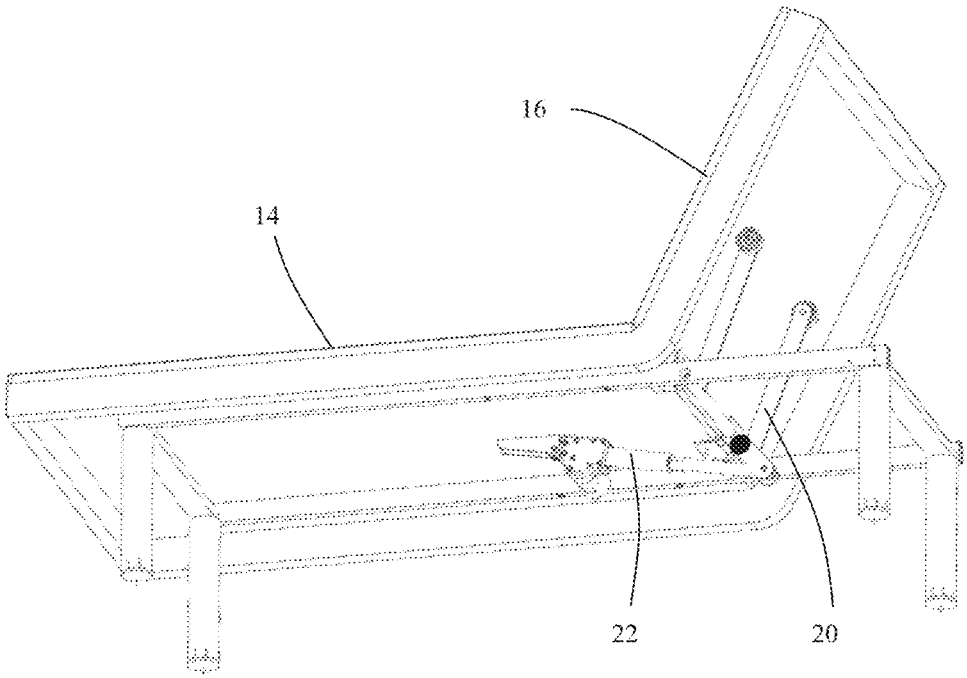
FIG. 2 is a perspective view of the motor-driven furniture of FIG. 1, showing a liftable part of the furniture in a lifted position.

Referring to FIG. 1 and FIG. 2, the motor-driving bed 10 generally includes a frame 12 and a motor-driving mechanism mounted to the frame 12 to lift a liftable part of the bed 10. The motor-driving bed 10 may generally include a platform or mattress base 14 supported on the frame 12, for supporting a mattress. In this embodiment, the platform 14 is a separated part from the mattress. In some other embodiments, the platform 14 may be integrated in the mattress.

In this embodiment, the liftable part of the bed 10 is a part 16 of the platform 14, such as, a backrest 16 or a foot rest. The motor-driven bed 10 allows a user to adjust the tilt of the backrest or to elevate the foot rest by operating the motor-driving mechanism to accomplish the desired movement of the liftable part. In the following, the invention will be described using the mechanism to elevate the backrest 16 of the bed 10, although the same applies to the foot rest or another furniture part.

The frame 12 may be supported on a plane, such as a floor, with a plurality of detachable or foldable legs 18. During transportation of the bed, the legs 18 are folded to the frame 12 or removed from the frame 12. In some other embodiments, the frame 12 may also be supported on a plane using another support means such as a supporting bracket.

Figure 3:
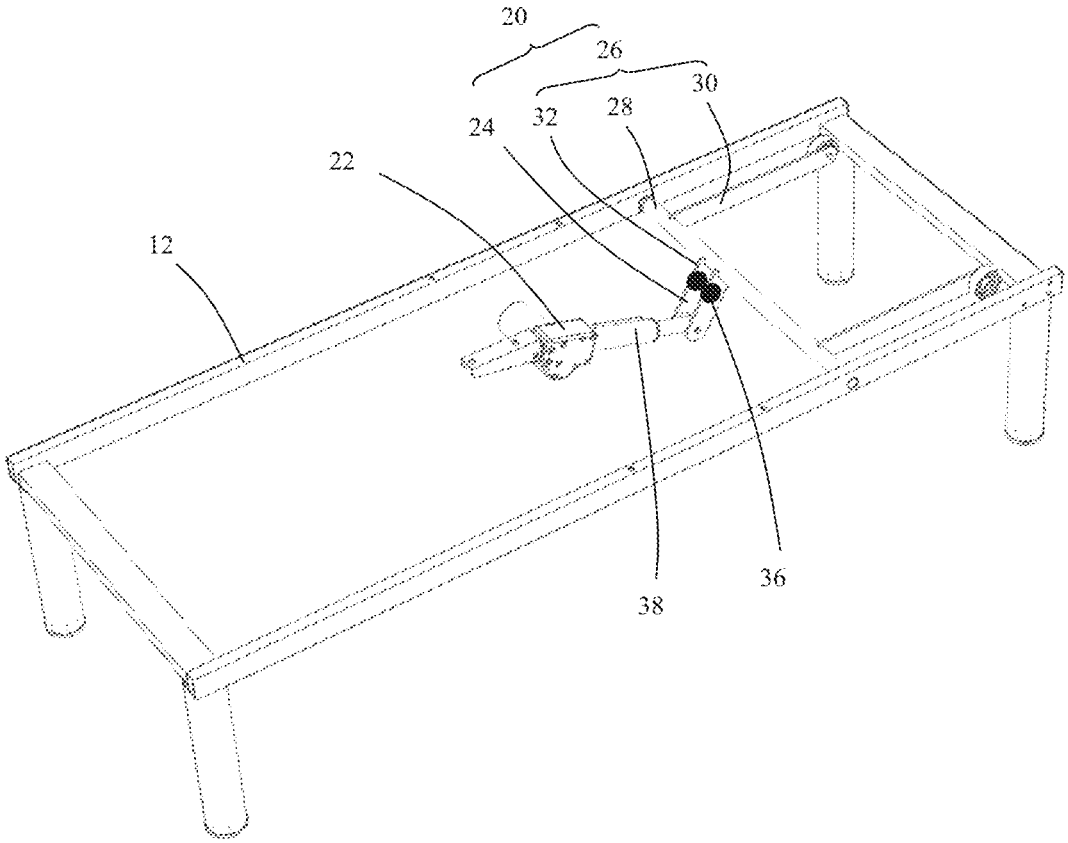
FIG. 3 is a perspective view of the motor-driven furniture of FIG. 1, with a platform removed, showing a lifting lever in a lowered position.
Figure 4:
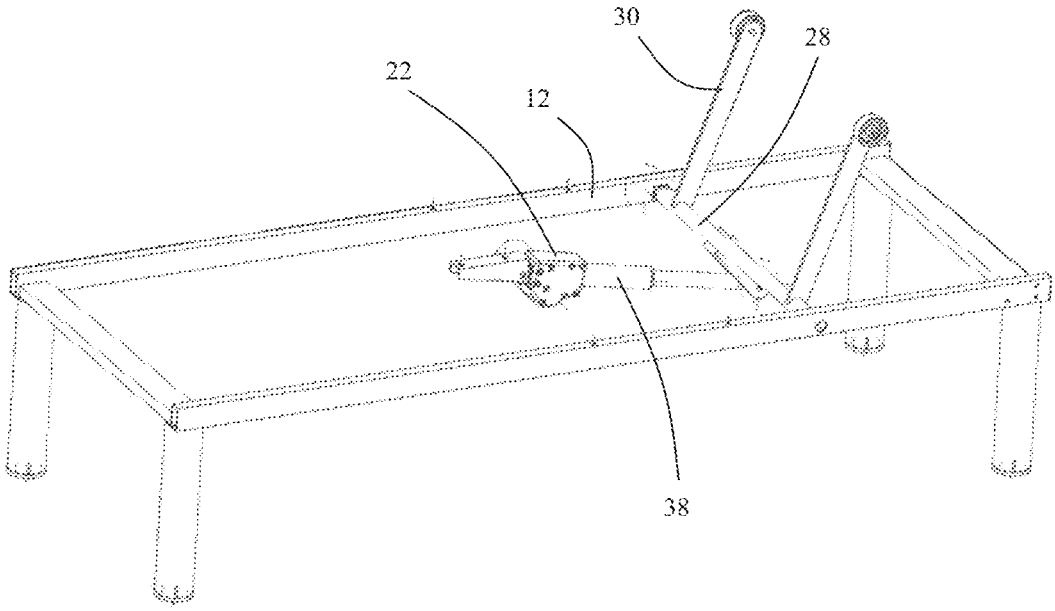
FIG. 4 is a perspective view of the motor-driven furniture of FIG. 1, with a platform removed, showing the lifting lever in a lifted position.

In the illustrated embodiment, the motor-driving mechanism includes a lifting lever 20 rotatably mounted to the frame 12 and a motor 22 connected to the lifting lever 20 for driving the lifting lever 20 with respect to the frame 12. The lifting lever 20 is rotatable between a lifted position and a lowered position. The lowered position is shown in FIG. 1 and FIG. 2, in which the backrest 16 is coplanar with the remaining part of the platform 14. In some other embodiments, the backrest 16 may also be at a predetermined angle to the remaining part of the platform 14 when in the lowered position. The lifted position is shown in FIG. 3 and FIG. 4, in which the backrest 16 is at an angle to the remaining part of the platform 14. The angle of the backrest 16 is adjustable by operating the motor-driving mechanism.

FIG. 3 and FIG. 4 further illustrate the lowered position and the lifted position of the lifting lever 20 with the platform 14 removed to more clearly show the positions. The lifting lever 20 includes a first section 24 and a second section 26. The first section 24 is pivotably connected to the motor 22. The second section 26 is connected to the first section 24 in such a way that the first section 24 and the second section 26 as a whole are drivable by the motor 22 to rotate in a first direction from the lowered position toward the lifted position, and the first section 24 is drivable by the motor 22 to rotate relative to the second section 24 in a second direction from the lowered position toward a third position while the second section 26 remains at the lowered position, the second direction being opposite to the first direction.

The lifting lever 20 can achieve the above function in various ways. In the illustrated embodiment, the second section 26 includes a rotating axle 28, and a pair of lifting arms 30 and a connecting lever 32 are fixedly attached to the rotating axle 28. The rotating axle 28 is pivotably mounted to the frame 12. The lifting arms 30 support the backrest 20. The number of the lifting arms 30 may vary depending on actual requirements such as weight and width of the bed.

One end of the first section 24 is pivotably connected to the connecting lever 32 at a rotary joint 36, and the other end of the first section 24 is pivotably connected to the motor 22. The first section 24 and the connecting lever 32 form a locking mechanism which prevents rotation of the first section 24 in the first direction relative to the connecting lever 32 while permitting rotation of the first section 24 in the second direction relative to the connecting lever 32.

Figure 5:
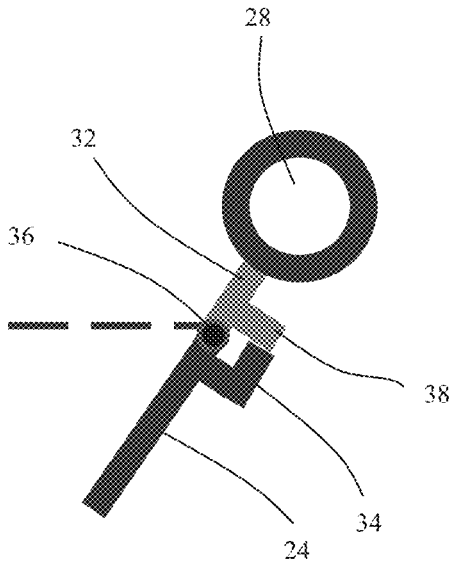
FIG. 5 illustrates a locking mechanism according to one embodiment.
Figure 6:
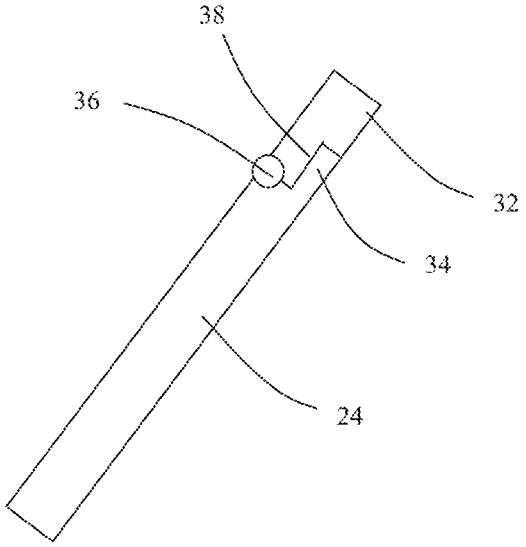
FIG. 6 illustrates a locking mechanism according to another embodiment.

FIG. 5 illustrates a non-limiting example of a construction for achieving such a function. The first section 24 forms a first engaging portion 34 adjacent a rotary joint 36 between the first section 24 and the connecting lever 32. The connecting lever 32 forms a second engaging portion 38 adjacent the rotary joint 36. The first engaging portion 34 and the second engaging portion 38 are formed on the same side of the first section 34 and the connecting lever 32. When the first section 24 rotates away from the connecting lever 32 in the second direction (e.g. the clockwise direction in FIG. 5), the first engaging portion 34 and the second engaging portion 38 are separated and thus do not prevent such a relative rotation. However, when the first section 24 rotates in the first direction (e.g. the counterclockwise direction in FIG. 5) and the first section 24 is already at a position in line with the connecting lever 32, the first engaging portion 34 and the second engaging portion 38 abut against each other to thereby prevent further rotation of the first section 24 in the first direction relative to the connecting lever 32. At this time, the motor 16 is able to drive the first section 24 and the second section 26 as a whole to rotate in the first direction to lift the backrest 16.

In the embodiment of FIG. 5, the locking mechanism includes the first engaging portion 34 formed on the first section 24 and the second engaging portion 38 formed on the connecting lever 32. In this embodiment, the first engaging portion 34 and the second engaging portion 38 are both implemented as protrusions extending from the corresponding first section 24 and the connecting lever 32. In another embodiment illustrated in FIG. 6, one of the first and second engaging portions 34, 38 is a protrusion 34, the other 38 is a recess 38, and the protrusion 34 is engaged in the recess 38 to achieve the locking function. It should be noted that all the examples described herein are for the purposes of illustration only and therefore should not be regarded as limiting. People skilled in the art would be able to come up with a variety of structures that achieve this locking function upon reading the present disclosure.

In the illustrated embodiment, the motor 22 is a linear motor 22. One end of the linear motor 22 is fixed to the platform 14, and the other end has a motor rod 39 pivotably connected to the first section 24. In another embodiment, the end of the motor 22 may be fixed to the bed frame 12.

Figure 7:
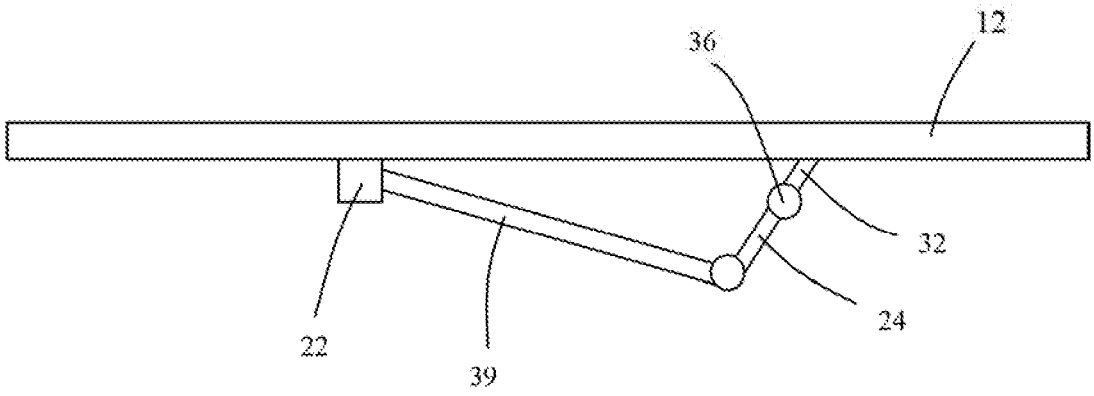
FIG. 7 is a schematic view showing the motor-driven furniture of FIG. 1 when the lifting lever is in the lowered position.

FIG. 7 is a schematic view showing the state of the motor-driving mechanism when the lifting lever is in the lowered position. Referring to FIG. 7, the first section 24 of the lifting lever 20 is at the lowered position, e.g. in line with the connecting lever 32 of the second section 26. At this time, the first section 24 and the connecting lever 32 protrude downwardly from the bed construction, both of which contribute to the thickness of the bed.

Figure 8:
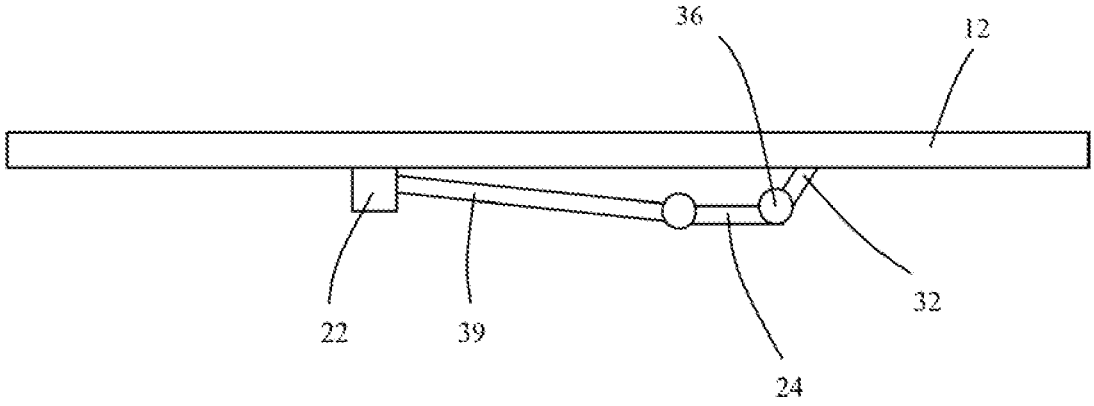
FIG. 8 is a schematic view showing a transportation state of the motor-driven furniture of Fig.

FIG. 8 is a schematic view showing a transportation state of the motor-driving mechanism. Referring to FIG. 8, the motor rod 39 of the motor 22 retracts to pull or rotate the first section 24 relative to the second section 26 from the lowered position toward the third position while the connecting lever 32 of the second section 26 remains at the lowered position. At the third position, the first section 24 can be oriented horizontally, which thus no longer increases the thickness of the bed. As such, the bed can have a significantly reduced thickness in this state. The reduced thickness can result in more beds to be loaded into one container during transportation.

As shown in FIG. 8, in this particular embodiment, the motor rod 38 is substantially horizontally oriented when the first section 24 is at the third position. It is noted, however, that the motor rod 38 can be disposed at another orientation when the first section 24 is at the third position. It is also noted that another suitable type of motor may be used as long as it can drive the first section 24 for rotation.

During operation, when the motor 22 starts pushing the lifting lever 20 from the third position (FIG. 8), it first rotates the first section 24 in the first direction from the third position toward the lowered position. Before the first section 24 reaches the lowered position, the motor 22 does not cause any lifting of the backrest 16. Once the first section 24 has been pushed to the lowered position, such as, to a degree that it is in line with the connecting lever 32, the locking mechanism prevents the first section 24 from further rotating relative to the connecting lever 32. Therefore, a torque is transmitted to the rotating axle 28 which lifts the backrest 16 toward the lifted position.

If the user wants to lower the backrest 16, he or she may operate the motor using a controller, for example, pressing a "down" button on a handset or remote controller. If the user keeps pressing the "down" button after the backrest 16 has already reached the lowered position, the motor 22 will pull the first section 24 to the third position. This can take several seconds to pull the first section 24 from the lowered position to the third position. If the user later on wants to raise the backrest 16 again, it will take as long to push the first section 24 to the lowered position. During this period of time, the user will not notice any function in the bed and may have the impression that something is wrong with his or her bed and call for service. This is certainly not desired at least for some users.

One way of addressing this problem is to provide the motor 22 with a first stop position, a second stop position and a third stop position in between the first and second stop positions, and the first stop position corresponds to the third position of the first section 24 of the lifting lever 26, the second stop position corresponds to the lifted position of the lifting lever 26, and the third stop position corresponds to the lowered position of the lifting lever 26. Therefore, the first stop position and the second stop position define the full stroke of the motor 22.

When the user operates his bed the first time after installation to drive up the backrest 16, the motor 22 pushes the first section 24 and then the whole lifting lever 26 to raise the backrest 16 until the motor 22 is stopped at the second stop position. At this time, the backrest 16 is at the lifted position. When the user lowers the backrest 16, the motor will stop in the third stop position, which corresponds to the lowered position of the backrest 16 which is coplanar with the rest of the platform 14. These stop positions can be achieved in various ways. For example, the motor 22 may have a first limit switch S1, a third limit switch S2 and a third limit switch S3 corresponding to the first stop position, the second stop position and the third stop position, respectively. The handset or controller for controlling the motor 22 can overwrite the third switch S3 on the way up in the first direction toward the lifted position but cannot overwrite the third limit switch S3 on the way down in the second direction away from the lifted position. Therefore, when lowering the backrest, the motor will be stopped by the third limit switch S3. Therefore, the user can make use of the full stroke (S1 to S2) of the motor only once, i.e. the first time after installation of the bed. Thereafter, the motor is restricted to the stroke between S3 and S2.

In the factory, however, for packaging in the most compact way, another handset would be used to allow to overwrite the third limit switch S3 and move the motor in until stopped by the second limit switch S2.

FIG. 9 to FIG. 16 illustrate a motor-driven furniture according to one embodiment. In this embodiment, the motor-driven furniture is also illustrated as a motor-driven bed which has a liftable part drivable by a motor-driving mechanism. Those skilled in the art will appreciate that the present invention can be equally applied to another type of furniture with liftable part, such as, power chairs, upon reading the teachings of this disclosure.

Figure 9:
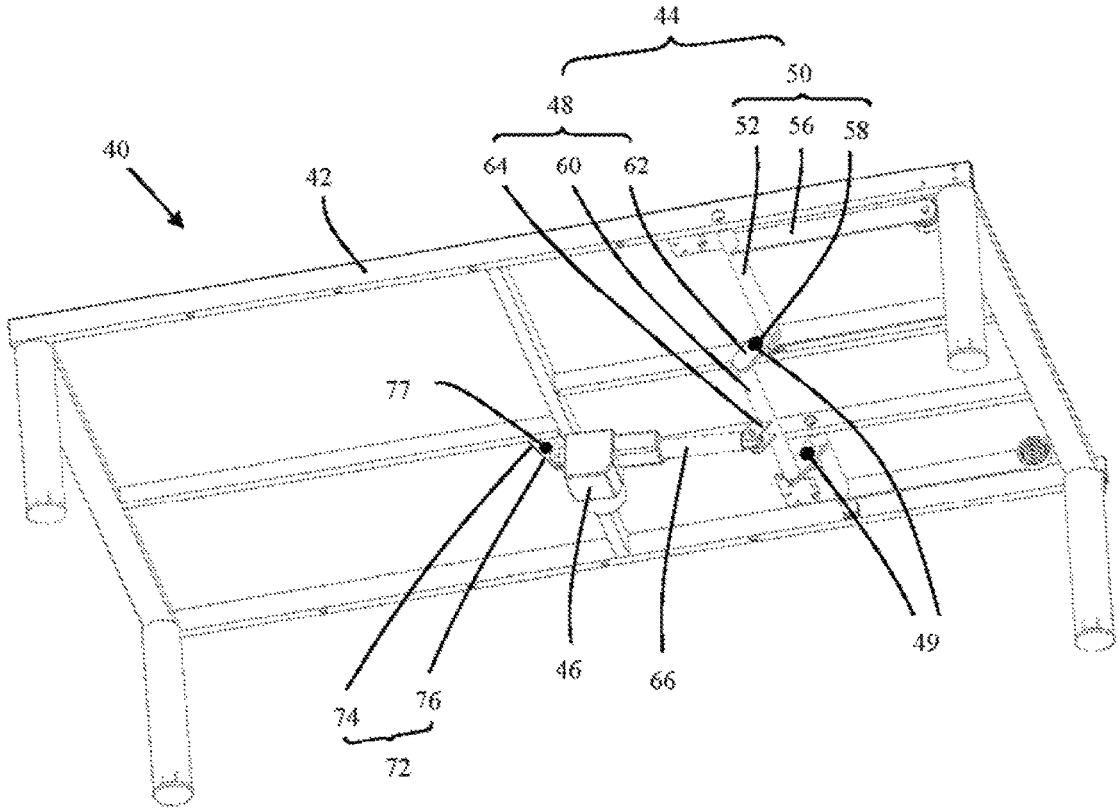
FIG. 9 is a perspective view of a motor-driven furniture according to another embodiment, with a platform removed, showing a lifting lever in a lowered position.
Figure 10:
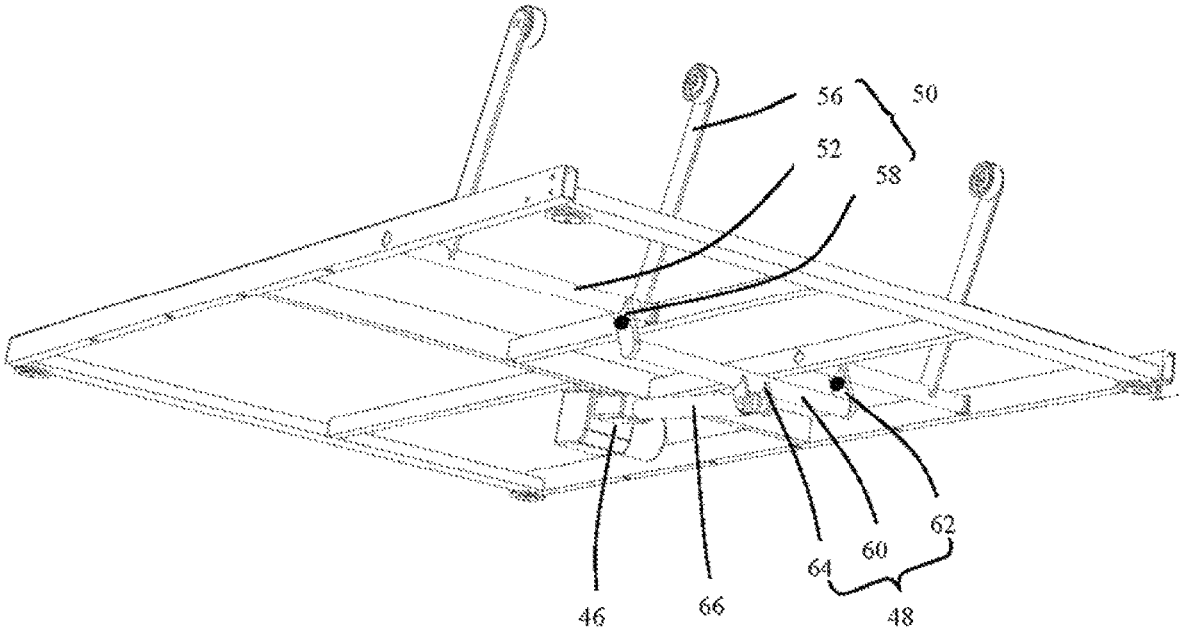
FIG. 10 is a perspective view of the motor-driven furniture, with the platform removed, showing the lifting lever in a lifted position.

Referring to FIG. 9 and FIG. 10, the motor-driving bed 40 generally includes a frame 42 and a motor-driving mechanism mounted to the frame 42 to lift a liftable part of the bed 40. The motor-driving bed 40 may generally include a platform or mattress base (not shown) supported on the frame 42, for supporting a mattress. The platform or mattress base likewise has a backrest as the liftable part of the bed but is wider than the platform 14 of FIG. 1. Due to the increased width, the motor-driving mechanism includes more lifting arms as described below.

The motor-driving mechanism operates in a similar manner as in the embodiment of FIG. 1 to FIG. 8 but has a different construction. In this embodiment, the motor-driving mechanism includes a lifting lever 44 rotatably mounted to the frame 42 and a motor 46 connected to the lifting lever 44 for driving the lifting lever 44 with respect to the frame 42. The lifting lever 44 is rotatable between a lifted position shown in FIG. 10 and a lowered position shown in FIG. 9.

The lifting lever 44 includes a first section 48 and a second section 50. The first section 48 is pivotably connected to the motor 46 at a rotary joint 49. The second section 50 is connected to the first section 24 in such a way that the first section 48 and the second section 50 as a whole are drivable by the motor 46 to rotate in a first direction from the lowered position toward the lifted position, and the first section 48 is drivable by the motor 46 to rotate relative to the second section 50 in a second direction from the lowered position toward a third position while the second section 50 remains at the lowered position, the second direction being opposite to the first direction.

The second section 50 includes a rotating axle 52 having a plurality of separate rotating axle sections 54 each fixedly attached with one or more lifting arms 56. A plurality of connecting levers 58 are fixedly attached to the rotating axle sections 54, respectively. The rotating axle 52 is illustrated as including two separate rotating axle sections 54, and two connecting levers 58 are fixedly attached to the rotating axle sections 54, respectively. In some other embodiments, the rotating axle 52 can have one or more than two separate rotating axle sections 54 depending upon actual requirements such as weight and width of the mattress. In this embodiment, the separate rotating axle sections 54 are coaxial. In some other embodiments, the rotating axle 52 may also be a single piece with a plurality of connecting levers fixed attached thereto.

The first section 48 includes a shaft 60, a plurality of connecting levers 62 fixedly attached to the shaft 60, and a motor connecting lever 64 fixedly attached to the shaft 60. Each of the plurality of connecting levers 62 of the first section 48 is pivotably connected to a corresponding one of the plurality of connecting levers 58 of the second section 50. The motor connecting lever 64 is pivotably connected to the motor 46. The motor 46 may also be a linear motor having a motor rod 66 pivotably connected to the motor connecting lever 64.

The connecting levers 62 of the first section 48 and the connecting levers 58 of the second section 50 form a locking mechanism which prevents rotation of the connecting levers 62 of the first section 60 in the first direction relative to the connecting levers 58 of the second section 50 while permitting rotation of the connecting levers 62 of the first section 48 in the second direction relative to the connecting levers 58 of the second section 50.

Figure 11:
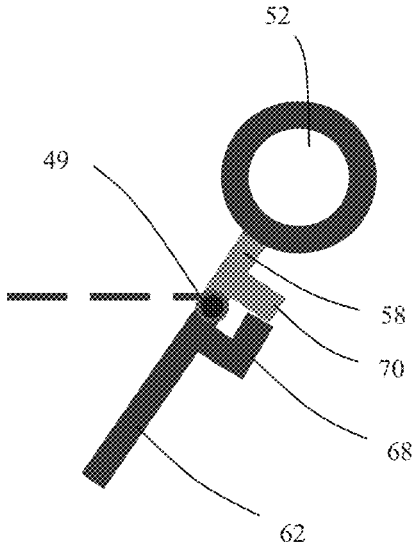
FIG. 11 illustrates a locking mechanism of the lifting lever according to one embodiment.

The locking mechanism of the connecting levers 62 and the connecting levers 58 may be constructed in the same manner as in the embodiment of FIG. 5. Referring to FIG. 11, for example, for each pair of connecting levers 62, 58, a first engaging portion 68 and a second engaging portion 70 are formed on the connecting levers 62, 58 adjacent the rotary joint 49, respectively. When the first section 48 rotates away from the second section 50 in the second direction, the first engaging portions 68 and their respective second engaging portions 70 are separated and thus do not prevent such a relative rotation. However, when the first section 48 rotates in the first direction (e.g. the counterclockwise direction in FIG. 5) and the connecting levers 62 of the first section 48 are already at a position in line with the connecting levers 58 of the second section 50, the first engaging portions 68 abut against their respective second engaging portions 70 to thereby prevent further rotation of the first section 48 in the first direction relative to the second section 50. At this time, the motor 46 is able to drive the first section 48 and the second section 50 as a whole to rotate in the first direction to lift the backrest.

In this embodiment, the locking mechanism includes the first engaging portions 68 formed on the connecting levers 62 of the first section 48 and the second engaging portions 70 formed on the connecting levers 58 of the second section 50. In this embodiment, the first engaging portion 68 and the second engaging portion 70 are implemented as protrusions extending from the connecting levers 62, 58. In another embodiment illustrated in FIG. 12, one of the first and second engaging portions 68, 70 is a protrusion 68, the other 70 is a recess 70, and the protrusion 68 is engaged in the recess 70 to achieve the locking function. It should be noted that all the examples described herein are for the purposes of illustration only and therefore should not be regarded as limiting. People skilled in the art would be able to come up with a variety of structures that achieve this locking function upon reading the present disclosure.

Different from the embodiment of FIG. 1, the motor 46 of this embodiment is attached to the frame 42 of the bed by a connecting lever 72. The connecting lever 72 includes a first connecting piece 74 and a second connecting piece 76. The first connecting piece 74 is fixedly attached to the frame 42, and the second connecting piece 76 is rotatably connected to the first connecting piece 74 at a rotary joint 77 for rotation between an upper position and a lower position. The connecting lever 72 forms a locking mechanism to prevent rotation of the second connecting piece 76 away from the upper position while permitting rotation of the second connecting piece 76 toward the upper position when the second connecting piece 76 is at the lower position.

Figure 12:
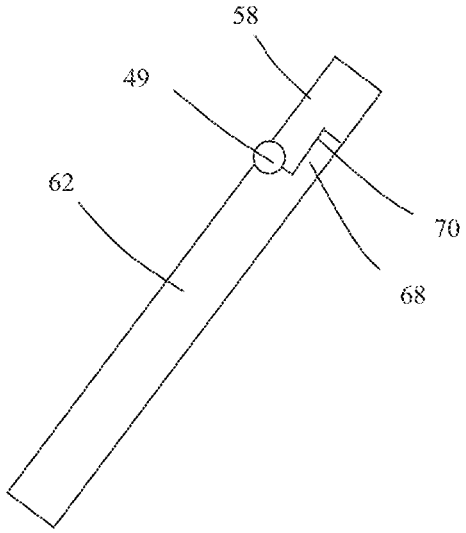
FIG. 12 illustrates a locking mechanism of the lifting lever according to another embodiment.
Figure 13:
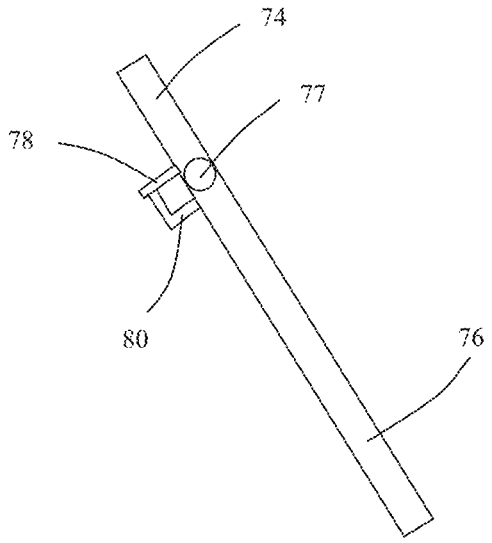
FIG. 13 illustrates a locking mechanism of a connecting lever according to one embodiment.
Figure 14:
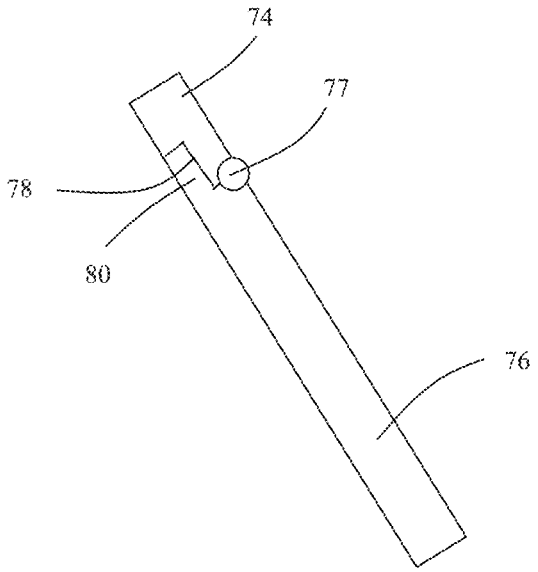
FIG. 14 illustrates a locking mechanism of the lifting lever according to another embodiment.

The locking mechanism of the connecting lever 72 may be constructed in the same manner as the locking mechanism of FIG. 11 and FIG. 12. For example, the locking mechanism of the connecting lever 72 includes a first engaging portion formed on the first connecting piece 74 and a second engaging portion formed on the second connecting piece 76. Referring to FIG. 13, in one embodiment, the first engaging portion and the second engaging portion are both implemented as protrusions 78, 80 extending from the corresponding connecting pieces 74, 76. In another embodiment illustrated in FIG. 14, one of the first and second engaging portions 78, 80 is a protrusion 80, the other is a recess 78, and the protrusion 80 is engaged in the recess 78 to achieve the locking function. It should be noted that all the examples described herein are for the purposes of illustration only and therefore should not be regarded as limiting. People skilled in the art would be able to come up with a variety of structures that achieve this locking function upon reading the present disclosure.

Figure 15:
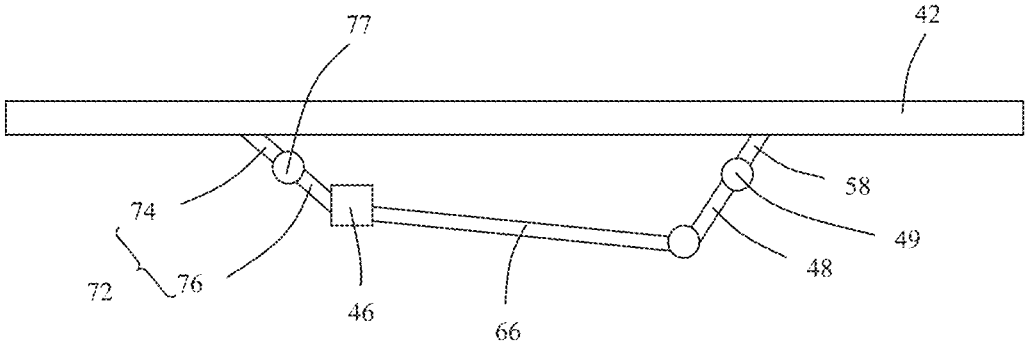
FIG. 15 is a schematic view showing the motor-driven furniture of FIG. 9 when the lifting lever is in the lowered position.

FIG. 15 is a schematic view showing the state of the motor-driving mechanism when the lifting lever is in the lowered position. Referring to FIG. 15, the first section 48 of the lifting lever 44 is at the lowered position, e.g. in line with the connecting levers 58 of the second section 58. In addition, the second connecting piece 76 of the connecting lever 72 is at the lower position, e.g. in line with the first connecting piece 74 of the connecting lever 72. At this time, the whole connecting lever 72 as well as the first section 48 and the connecting levers 58 of the second section 50 protrude downwardly from the bed construction, all of which contribute to the thickness of the bed.

Figure 16:
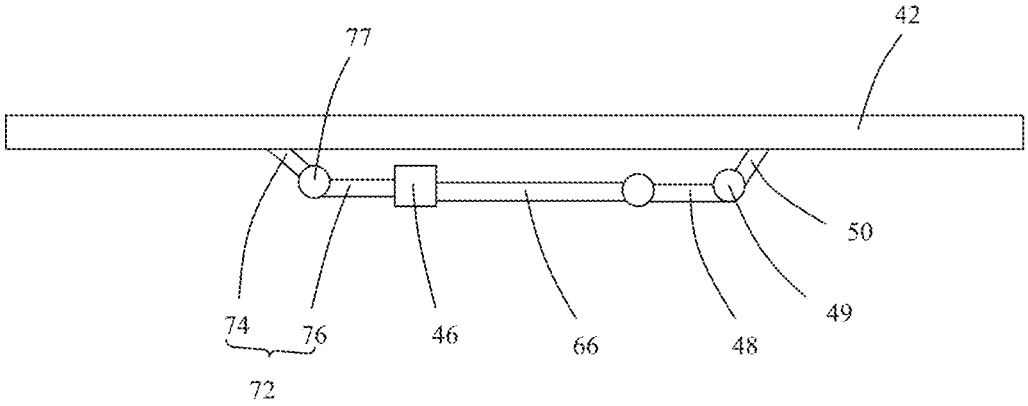
FIG. 16 is a schematic view showing a transportation state of the motor-driven furniture of FIG. 9.

FIG. 16 is a schematic view showing a transportation state of the motor-driving mechanism. Referring to FIG. 16, the motor rod 66 retracts to pull or rotate the first section 48 from the lowered position to the third position while the connecting levers 58 of the second section 50 remain at the lowered position. At the third position, the first section 24 for example can be oriented horizontally, which thus no longer increases thickness of the bed. In addition, the second connecting piece 76 of the connecting lever 72 rotates from the lower position to the upper position, which for example can be oriented horizontally and likewise no longer increases the thickness of the bed. As such, the bed can have a significantly reduced thickness in this state. For a specific motor-driven bed, the combination of the connecting lever 72, the motor 46 and the lifting lever 44 in this state has a smallest size protruding beyond the frame 42 in the direction perpendicular to the frame 42. The reduced thickness can result in more beds to be loaded into one container during transportation.

Similarly to the embodiment of FIG. 1 to FIG. 8, the motor 46 of the present embodiment can also have a first stop position, a second stop position and a third stop position in between the first and second stop positions. The first stop position corresponds to the third position of the first section 48 of the lifting lever 44 and the upper position of the second connecting piece 76 of the connecting lever 72. The second stop position corresponds to the lifted position of the lifting lever 44, and the third stop position corresponds to the lowered position of the lifting lever 44 and the lower position of the second connecting piece 76 of the connecting lever 72. Therefore, the first stop position and the second stop position define the full stroke of the motor 46. The motor 46 may have a first limit switch S1, a third limit switch S2 and a third limit switch S3 corresponding to the first stop position, the second stop position and the third stop position, respectively. The handset or controller for controlling the motor 46 can overwrite the third switch S3 on the way up in the first direction toward the lifted position but cannot overwrite the third limit switch S3 on the way down in the second direction away from the lifted position. Therefore, when lowering the backrest, the motor will be stopped by the third limit switch S3. Therefore, the user can make use of the full stroke (S1 to S2) of the motor only once, i.e. the first time after installation of the bed. Thereafter, the motor is restricted to the stroke between S3 and S2 during normal operation.

In summary, the lifting lever includes a first section and a second section. The first section is rotatable from the lowered position to the third position, thus reducing the thickness of the motor-driving mechanism and the motor-driven furniture utilizing the motor-driving mechanism. In some embodiments, the motor is connected to the furniture by a connecting lever having a first connecting piece and a second connecting piece. The second connecting piece is rotatable from the lower position to the upper position, which further reduces the thickness of the motor-driving mechanism and the motor-driven furniture utilizing the motor-driving mechanism. The reduced thickness can result in more beds to be loaded into one container during transportation and as a result, the shipping cost per unit is reduced.

It will be apparent to those skilled in the art that various modifications and variations can be made to the disclosed structure without departing from the scope or spirit of the invention. In view of the foregoing, it is intended that the present invention cover modifications and variations of this invention provided they fall within the scope of the following claims and their equivalents.

What is claimed is:

1. A motor-driven furniture comprising:

a frame;

a motor; and a lifting lever mounted to the frame for rotation between a lifted position in which a liftable part of the furniture is lifted and a lowered position in which the liftable part of the furniture is lowered, the lifting lever comprising a first section and a second section connected to the first section, the second section configured to support the liftable part of the furniture, the first section pivotably connected to the motor, the second section connected to the first section in such a way that the first section and the second section are fixedly connected and as a whole are drivable by the motor to rotate in a first direction from the lowered position toward the lifted position, and the first section is not fixedly connected to the second section and is drivable by the motor to rotate relative to the second section in a second direction from the lowered position toward a third position while the second section remains at the lowered position, the second direction being opposite to the first direction.

2. The motor-driven furniture of claim 1, wherein the motor comprises a linear motor having a motor rod pivotably connected to the first section, and the motor rod is substantially horizontally oriented when the first section is at the third position.

3. The motor-driven furniture of claim 1, wherein the motor has a first stop position, a second stop position and a third stop position in between the first and second stop positions, the first stop position and the second stop position define a full stroke of the motor, the first stop position corresponds to the third position of the first section of the lifting lever, the second stop position corresponds to the lifted position of the lifting lever, and the third stop position corresponds to the lowered position of the lifting lever.

4. The motor-driven furniture of claim 1, wherein the first section and the second section form a locking mechanism which prevents rotation of the first section in the first direction relative to the second section while permitting rotation of the first section in the second direction relative to the second section.

5. The motor-driven furniture of claim 4, wherein the locking mechanism of the first section and the second section comprises a first engaging portion formed on the first section adjacent a joint between the first section and the second section and a second engaging portion formed on the second section adjacent the joint, and the first and second engaging portions cooperatively prevent rotation of the first section in the first direction relative to the second section by abutting against each other.

6. The motor-driven furniture of claim 5, wherein the first engaging portion comprises a first protrusion, the second engaging portion comprises a second protrusion, and the first protrusion and the second protrusion prevent rotation of the first section in the first direction relative to the second section by abutting against each other.

7. The motor-driven furniture of claim 5, wherein the first engaging portion comprises a protrusion, the second engaging portion comprises a recess, and the protrusion is engaged in the recess to prevent rotation of the first section in the first direction relative to the second section.

8. The motor-driven furniture of claim 1, wherein the second section comprises a rotating axle, one or more lifting arms and a connecting lever are fixedly attached to the rotating axle, the first section is pivotably connected to the connecting lever, the first section and the connecting lever form a locking mechanism which prevents rotation of the first section in the first direction relative to the connecting lever while permitting rotation of the first section in the second direction relative to the connecting lever.

9. The motor-driven furniture of claim 1, wherein the second section comprises a rotating axle having a plurality of separate rotating axle sections each fixedly attached with one or more lifting arms, a plurality of connecting levers are fixedly attached to the rotating axle sections, respectively, and the first section is pivotably connected to the plurality of connecting levers, the first section and the plurality of connecting levers form a locking mechanism which prevents rotation of the first section in the first direction relative to the plurality of connecting levers while permitting rotation of the first section in the second direction relative to the plurality of connecting levers.

10. The motor-driven furniture of claim 9, wherein the first section comprises a shaft and a plurality of connecting levers fixedly attached to the shaft, each of the plurality of connecting levers of the first section is pivotably connected to a corresponding one of the plurality of connecting levers of the second section, the locking mechanism is formed between each of the plurality of connecting levers of the first section and each of the plurality of connecting levers of the second section.

11. The motor-driven furniture of claim 10, wherein a motor connecting lever is fixedly attached to the shaft of the first section, and the motor comprises a linear motor having a motor rod pivotably connected to the motor connecting lever.

12. The motor-driven furniture of claim 1, wherein the furniture is a motor-driven bed, and the liftable part of the furniture is one of a backrest and a footrest of the motor-driven bed.

13. The motor-driven furniture of claim 1, wherein the furniture is a motor-driven bed, and the motor is connected to the bed by a connecting lever having first and second connecting pieces, the first connecting piece is fixedly attached to the bed, the second connecting piece is rotatably connected to the first connecting piece for rotation between an upper position and a lower position, and the connecting lever comprises a locking mechanism configured to prevent rotation of the second connecting piece in a direction away from the upper position while permitting rotation of the second connecting piece toward the upper position when the second connecting piece is at the lower position, wherein during the course of the lifting lever rotating from the lowered position toward the lifted position, the second connecting piece is at the lower position.

14. The motor-driven furniture of claim 13, wherein the first section and the second section form another locking mechanism which prevents rotation of the first section in the first direction relative to the second section while permitting rotation of the first section in the second direction relative to the second section; wherein the another locking mechanism comprises a first protrusion formed on one of the first section and the second section, and a second protrusion formed on the other of the first section and the second section, the first protrusion and the second protrusion prevent rotation of the first section in the first direction relative to the second section by abutting against each other.

15. The motor-driven furniture of claim 13, wherein the first section and the second section form another locking mechanism which prevents rotation of the first section in the first direction relative to the second section while permitting rotation of the first section in the second direction relative to the second section; wherein the another locking mechanism comprises a protrusion formed on one of the first section and the second section, and a recess formed on the other of the first section and the second section, the protrusion is engaged in the recess to prevent rotation of the first section in the first direction relative to the second section.

16. The motor-driven furniture of claim 1, wherein the motor-driven furniture is a motor-driven bed having a platform supported on the frame, the motor is connected to one of the frame and the platform by a connecting lever having first and second connecting pieces, the first connecting piece is fixedly attached to the one of the frame and the platform, the second connecting piece is rotatably connected to the first connecting piece for rotation between an upper position and a lower position, and the connecting lever comprises a locking mechanism configured to prevent rotation of the second connecting piece in a direction away from the upper position while permitting rotation of the second connecting piece toward the upper position when the second connecting piece is at the lower position, wherein when the first connecting piece is at the upper position and the first section of the lifting lever is at the third position, the combination of the connecting lever, the motor and the lifting lever has a smallest size protruding beyond the frame in a direction perpendicular to the frame.

* * * * *